US007526869B2

(12) United States Patent
Blatter et al.

(10) Patent No.: US 7,526,869 B2
(45) Date of Patent: May 5, 2009

(54) RAZOR HANDLE

(75) Inventors: Alan David Blatter, Hamden, CT (US); Donald P. Roche, Orange, CT (US); Wes Rhoad, Hamden, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 169 days.

(21) Appl. No.: 11/449,552

(22) Filed: Jun. 8, 2006

(65) Prior Publication Data

US 2007/0283566 A1 Dec. 13, 2007

(51) Int. Cl.
*B26B 21/52* (2006.01)

(52) U.S. Cl. ..... 30/532; 30/50; 30/527

(58) Field of Classification Search ..... 30/50, 30/526, 527, 530, 531, 532, 533
See application file for complete search history.

(56) References Cited

U.S. PATENT DOCUMENTS 4,094,063 A * 6/1978 Trotta ..... 30/47
4,970,784 A * 11/1990 Althaus et al. ..... 30/527
5,661,907 A * 9/1997 Apprille, Jr. ..... 30/47
5,890,296 A * 4/1999 Metcalf et al. ..... 30/526
6,112,412 A 9/2000 Richard
6,122,826 A * 9/2000 Coffin et al. ..... 30/57
6,311,400 B1 * 11/2001 Hawes et al. ..... 30/527
6,612,040 B2 * 9/2003 Gilder ..... 30/530
7,200,942 B2 * 4/2007 Richard ..... 30/526

FOREIGN PATENT DOCUMENTS

EP 1245351 A1 2/2002

OTHER PUBLICATIONS

International Search Report dated Nov. 15, 2007, for PCT/US2007/013102.

* cited by examiner

*Primary Examiner*—Hwei-Siu C Payer
(74) *Attorney, Agent, or Firm*—Energizer Personal Care, LLC

(57) ABSTRACT

A safety razor has a handle and a razor cartridge. The head portion of the handle has a biasing member and connecting structure to pivotally connect to mating connection structure of the cartridge. The cartridge can pivot about a pivot axis. A cam surface of the biasing member interacts with a cam surface of the housing of the cartridge to permit resilient movement of the cartridge away from an at-rest position in response to forces encountered during shaving. The connecting structure of the handle has first and second shell bearings which each have a fin at the inner end. The fin extends towards the pivot axis and a least a portion of the tip of the fin is closer to the pivot axis than any portion of the cam surface of the biasing member. The fin resists rotation of the cartridge about an axis perpendicular to the pivot axis.

13 Claims, 4 Drawing Sheets

RAZOR HANDLE

BACKGROUND

1. Field of the Invention

This invention relates generally to shaving devices, and more specifically to razor handles that provide a resilient pivotal connection to razor cartridges.

2. Background Information

In recognition that skin surfaces to be shaved are not planar, some modern shaving implements, commonly known as disposable safety razors, have a handle and a pivotally connected razor cartridge that are intended to be permanently coupled and disposed of as a single unit. Other safety razors include a disposable razor cartridge releasably connected to a reusable handle. The cartridge comprises a housing having at least one razor blade with a sharpened cutting edge disposed therein. During use, the razor cartridge can pivot relative to the handle about a pivot axis between a neutral, or at-rest, position and a rotated position. The razor cartridge can be adapted to pivot in one direction only away from the neutral position or in two directions. The ability of the razor cartridge to pivot between the neutral and rotated positions relative to the handle is desirable as this enables the razor cartridge and its associated razor blade(s) to maintain optimal contact with the skin surface being shaved during use. The handle is customarily provided with a biasing member that interacts with the razor cartridge to provide an at-rest position and to permit resilient pivotal movement of the razor cartridge away from the at-rest position in response to forces encountered during shaving. The bias force provided by the biasing member should be sufficient to prevent chatter of the cartridge in use but not be so great as to restrict or limit pivotal movement of the cartridge in response to the forces encountered during shaving.

The object of the present invention is to provide a safety razor having improved connection to and improved pivoting characteristics of a razor cartridge relative to a handle and manufacturing advantages for the handle.

SUMMARY

In one aspect, an embodiment of the invention features, in general a handle for a wet shaving razor. The handle comprises a grip portion and a head portion. The head portion comprises shell bearings adapted to slidably engage connecting structure of a razor cartridge to provide pivotal mounting on the handle about a pivot axis. The head portion further comprises a biasing member that can be bifurcated. The biasing member has a first end integrally coupled with the handle and a second end having a cam surface that is partially cylindrical. Fins extend from the inner ends of each shell bearing. The fins have tips and a portion of the tip is closer to the pivot axis than any portion of the cam surface to protect the biasing member during manufacture or handling. The head portion can also have a shield adjacent to at least a portion of the side surface of the biasing member to further protect the biasing member during manufacture or handling.

In a further aspect, an embodiment of the invention features, in general, a wet shaving razor. The razor includes a handle generally as described above and a razor cartridge pivotally mounted on the handle. The razor cartridge is adapted to pivot about a pivot axis and the cam surface of the biasing member acts upon a cam surface of the housing of the razor cartridge to provide the razor cartridge an at-rest position and to permit resilient movement of the razor cartridge away from the at-rest position in response to forces encountered during shaving. The resilient movement of the razor cartridge can be in one direction only or two directions away from the at-rest position. The fins of the head portion of the handle prevent rotation of the cartridge in an "end over end" direction.

In use, the handle of the safety razor of the embodiments of the present invention has improved connection to a razor cartridge. The handle provides improved pivoting characteristics of a razor cartridge relative to the handle. During manufacture, the embodiments of the handle of the present invention provide manufacturing advantages.

The above features and advantages of the present invention will be more fully understood with reference to the following detailed description when taken in conjunction with the accompanying drawings.

DETAILED DESCRIPTION OF THE INVENTION

Figure 1:
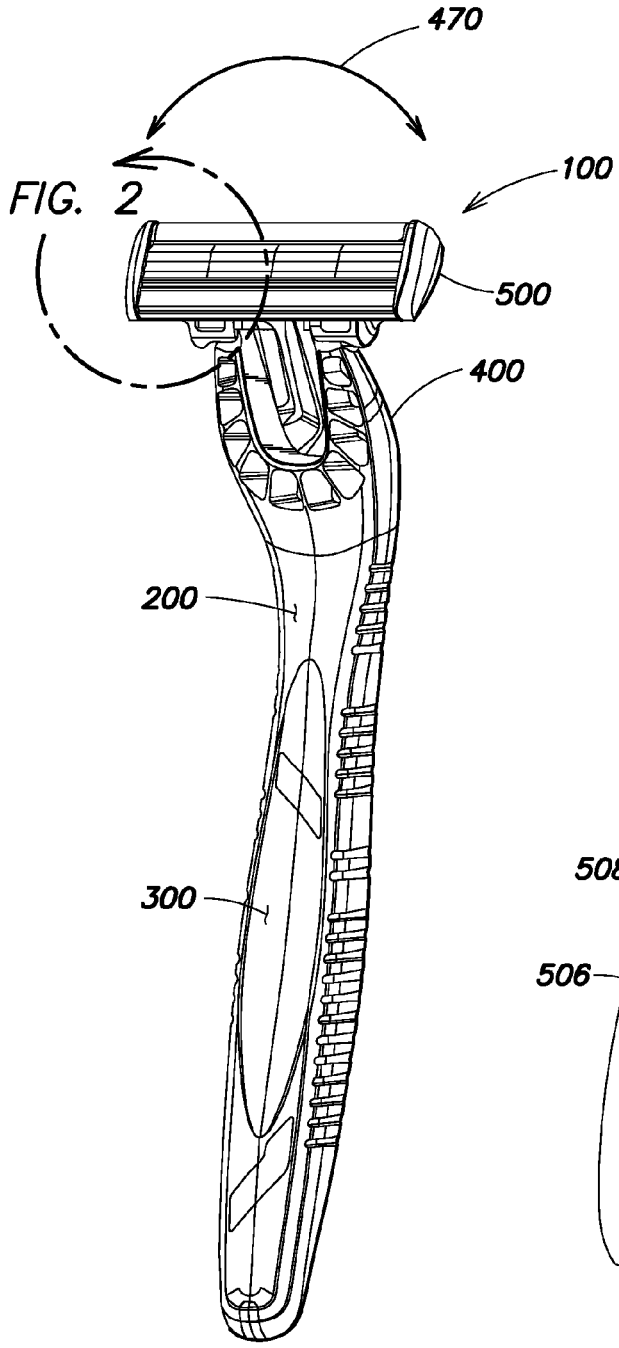
FIG. 1 is an isometric view from the front of an embodiment of a safety razor of the present invention.
Figure 2:
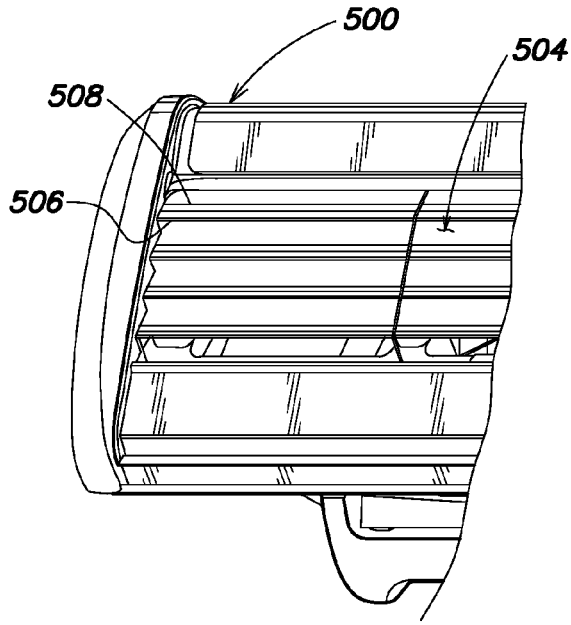
FIG. 2 is a detailed view of a portion of FIG. 1.
Figure 3:
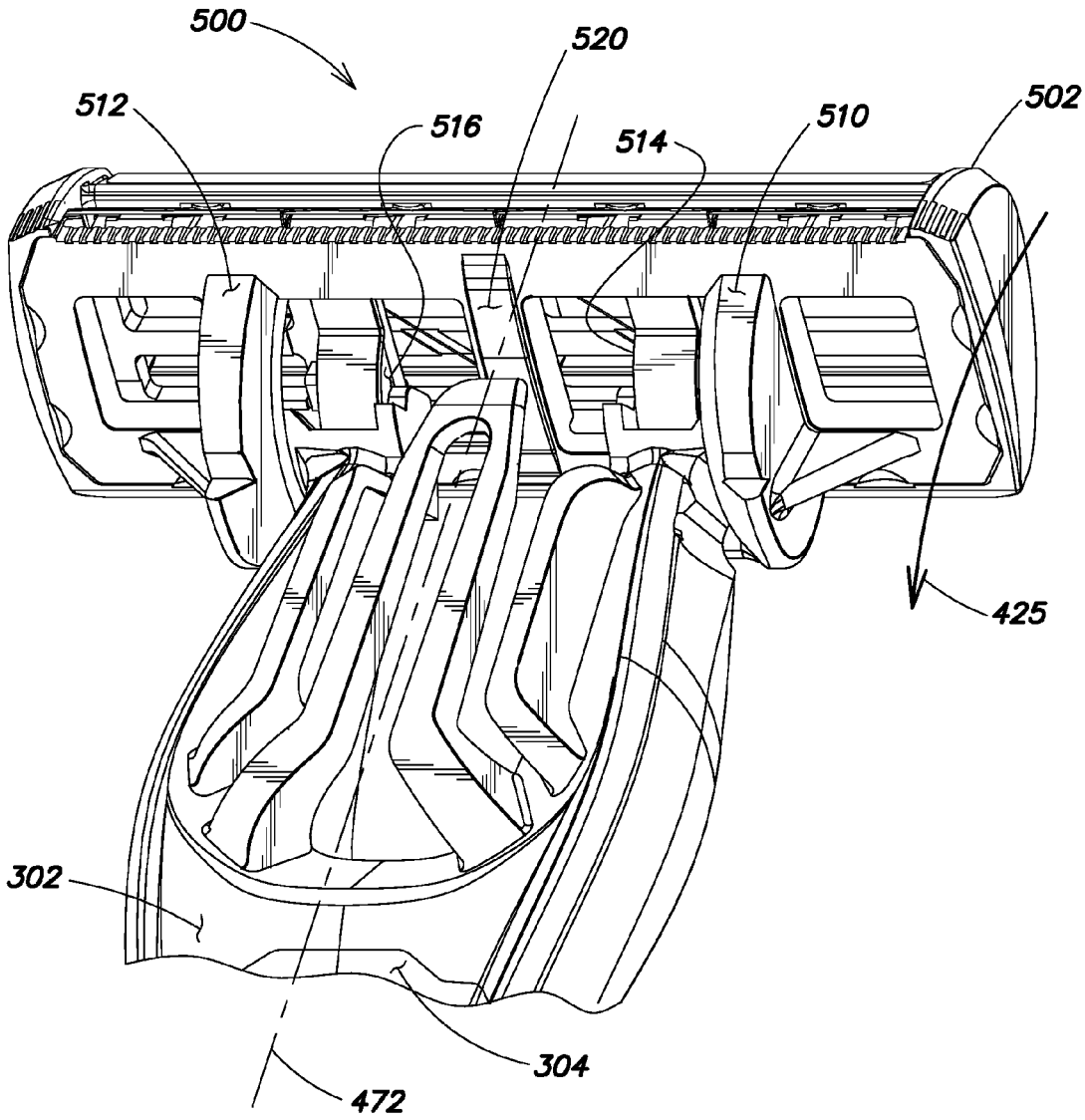
FIG. 3 is a detailed view of a portion of an isometric view from the rear of an embodiment of a safety razor of the present invention.
Figure 4:
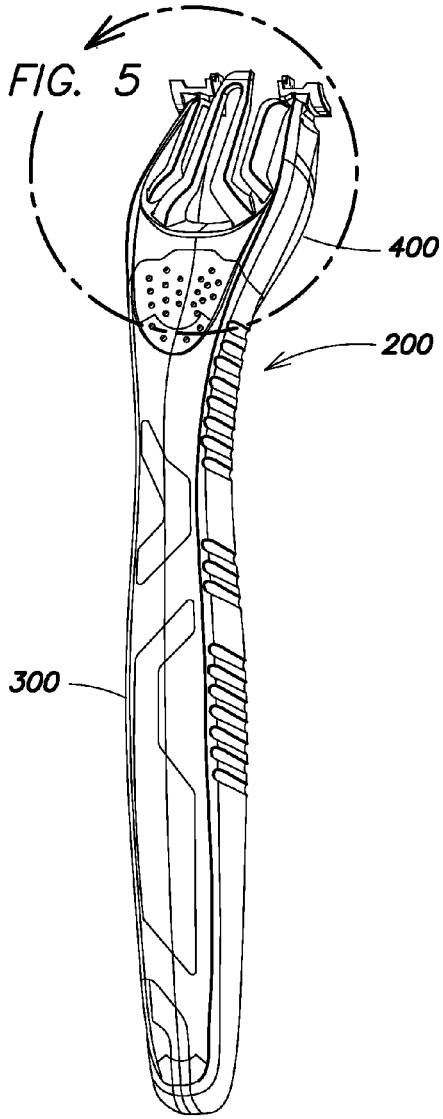
FIG. 4 is an isometric view from the rear of an embodiment of a razor handle of the present invention.
Figure 5:
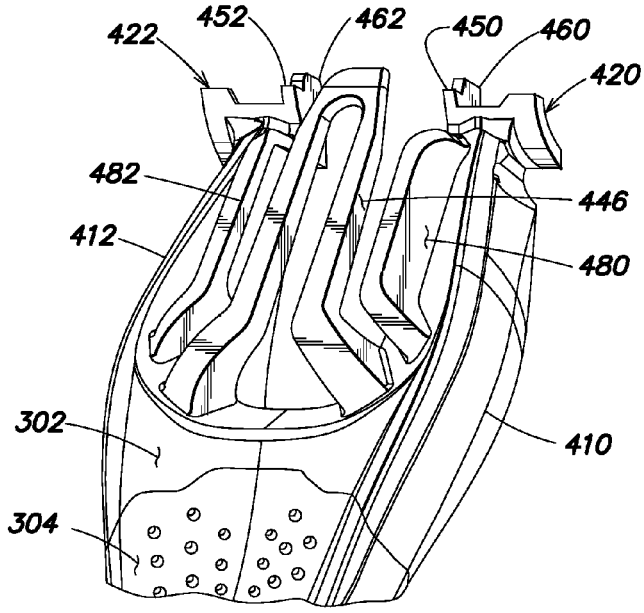
FIG. 5 is a detailed view of the head portion of the razor handle of FIG. 4, encircled 5.

Referring now to the drawings and in particular FIGS. 1-3, a safety razor 100 is shown. The razor comprises a handle 200, having a gripping portion 300 and a head portion 400, and a razor cartridge 500. In these figures the cartridge 500 is shown in its at-rest position relative to the handle 200. The cartridge comprises a housing 502 which has at least one razor blade 504 disposed therein. The razor blade has a rectilinear cutting edge 506 and at least a substantially planar body portion 508 adjacent the cutting edge. The housing 502 is preferably a one-piece injection molded component but can also be manufactured from two or more pieces joined together. The housing 502 has pivoting connecting structures 510, 512 that each include inner and outer shell bearing surfaces, terminating surfaces 514, 516 and a cam surface 520. The construction of razor cartridges with pivoting connecting structure having inner and outer shell bearings is well known in the art and is disclosed in detail in at least U.S. Pat. No. 4,586,255 to Jacobson, essential matter of which is herein incorporated by reference. The handle 200 is preferably a unitary injection molded component, most preferably made by a two-shot, also known as two-color, injection molding process. The handle comprises a first shot portion of a rigid material 302, preferably polypropylene and most preferably the grade designated AP5135-HS manufactured by the HUNTSMAN CO. This particular material is selected based on a balance of several preferred characteristics including injection molding process characteristics or moldability, frictional characteristics (as will be referenced later) and its ability to chemically bond to the second shot (as will also be referenced later). The handle comprises a second shot portion of a thermoplastic elastomeric material 304, that at least partially envelopes the first shot to provide enhanced hand gripping characteristics for a user, especially in a wet environment. The second shot can also provide an aesthetically pleasing appearance. The second shot is most preferably the thermoplastic elastomer (TPE) designated THERMOLAST KTF2ATL manufactured by the KRAIBURG CO. This particular TPE is selected based on a balance of several preferred characteristics including moldability; wet gripping characteristics and its ability to form a chemical bond to the polypropylene first shot at the interface between the polypropylene and TPE. This chemical bond satisfactorily bonds the second, TPE, shot on the first shot without the need for additional mechanical attachment means. One of skill in the art will understand other thermoplastic molding materials can also be selected for one or both the first and second shot. One of skill in the art will further understand the handle can also be constructed of two or more components joined together.

Referring now to FIGS. 4-8, these depict the head portion 400 of the razor handle 200 in diverse views. The head portion 400 has handle pivoting connecting structure that comprises a pair of spaced apart arms 410, 412, which each terminate in shell bearings 420, 422 respectively. The shell bearings slidably engage the connecting structure of the razor cartridge to provide pivotal mounting of the cartridge on the handle about a pivot axis 424. The polypropylene material of the first shot of the handle, which comprises at least the shell bearing members of the head portion, is selected at least for its frictional characteristics in that the cartridge can preferably freely pivot relative to the handle independently of any spring bias forces. The head portion 400 also comprises a biasing member 430. The biasing member has a first end 432, integrally coupled with the head portion, a preferably straight intermediate portion 434 and a second end 436 having a cam surface 438. The biasing member also has side surfaces 446. The cam surface 438 is preferably partially cylindrical although shapes approximating a partial cylinder can be utilized. The biasing member 430 preferably consists of the material of the first shot of the head portion but may also consist of the material of the second shot or may comprise both materials. The biasing member is preferably bifurcated at least for a portion of the intermediate portion. Bifurcation provides preferential lateral and torsional stability of the biasing member compared to a unitary structure having the same bending characteristics as a bifurcated biasing member. Lateral stability in this instance is defined as stability in a direction approximately as depicted by reference numeral 440 and torsional stability is defined as stability about an axis passing generally through the first and second ends of the biasing member. Bending characteristics are defined as bending in a direction approximately as depicted by reference numeral 442. The cam surface 438 of the biasing member 430 acts upon the cam surface 520 of the housing 502 to provide the razor cartridge an at-rest position and to permit resilient movement of the razor cartridge away from the at-rest position in response to forces encountered during shaving. As the cartridge pivots away from its at-rest position the cam surface 502 of the housing 502 contacts the cam surface 438 of the biasing member 430 causing the biasing member to elastically deflect substantially in plane 442. Cartridge pivoting is most preferably in a single, rearward, direction away from the at-rest position depicted by arc having reference numeral 425 and is at least an arc of travel of 20°. Cartridge pivoting may also be in two directions where the arc of travel in the rearward direction is greater than the arc of travel in an opposite direction.

The inner ends of each shell bearing 420, 422 have a fin 450, 452 respectively extending in a plane generally perpendicular to the pivot axis 424. Each fin has a tip 460, 462 respectively at the outer end thereof. At least a portion of each tip is closer to the pivot axis 424 than any portion of the cam surface 438 of the biasing member 430. The tips of the fins provide protection to the cam surface during manufacture or bulk storage or handling of the handle before the cartridge is assembled to the handle. In the event that the head portion is accidentally pushed against a hard surface the tips will contact the hard surface first and prevent damage to the biasing member. When a cartridge is assembled to the handle the fins interact with the terminating surfaces 514, 516 of the pivoting connecting structure of the cartridge to substantially prevent rotation of the cartridge in an "end over end" direction as depicted by arrow reference numeral 470 in FIG. 1. "End over end" can also be defined as rotation about an axis 472 (also in FIG. 3) that is both perpendicular to the pivot axis 424 and generally perpendicular to the body portion of the razor blade 508.

The head portion 400 also comprises shields 480, 482 extending inwardly from arms 410, 412. At least a portion of the shield is adjacent and preferably extends above at least a portion of a side surface 446 of the biasing member (as depicted by the dimension having reference numeral 447 in FIG. 8A). In this manner the shields prevent accidental damage to the biasing member during manufacture or bulk storage or handling of the handle from, for instance, contact with a second handle. The shields also substantially prevent a user from accidentally deflecting the biasing member with, for instance, her finger tip during use. Deflection of the biasing member independent of cartridge pivoting could remove contact of the cam surface of the biasing member with the cam surface of the housing, thereby preventing the biasing member from providing resilient pivoting movement of the cartridge in response to forces encountered during shaving.

Figure 8A:
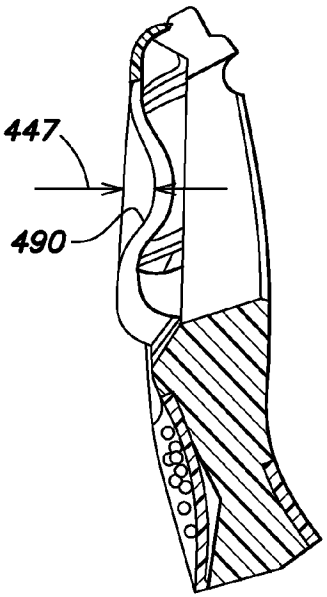
FIG. 8A is a partial sectional view on line 8-8 of FIG. 6 of a second embodiment of a safety razor of the present invention.
Figure 8:
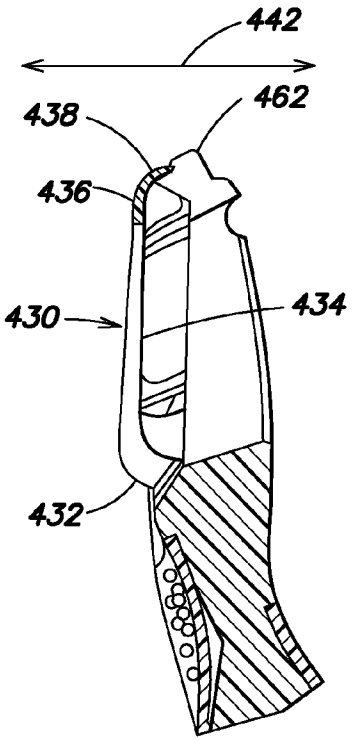
FIG. 8 is a partial sectional view on line 8-8 of FIG. 6.
Figure 7:
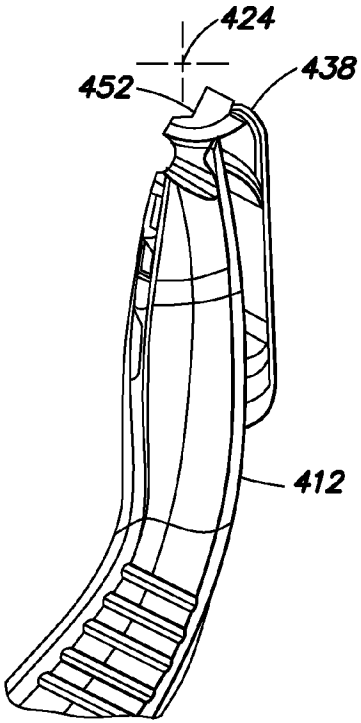
FIG. 7 is a partial side view of the head portion of an embodiment of a razor handle of the present invention.
Figure 6:
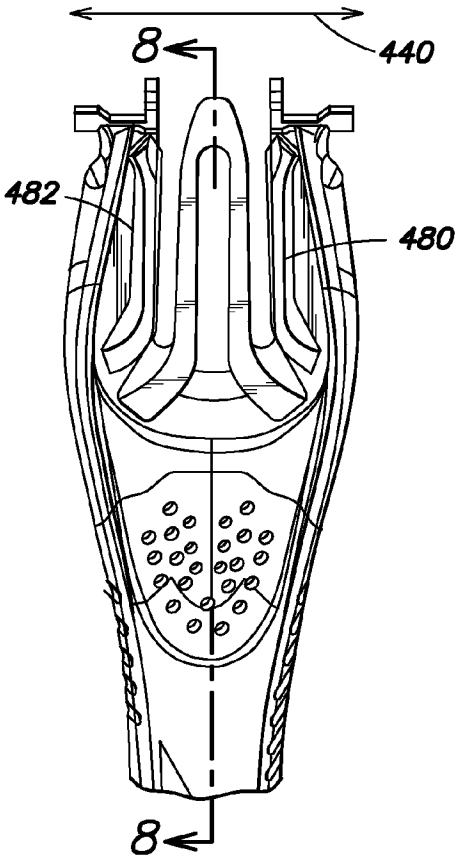
FIG. 6 is a partial plan view of the head portion of an embodiment of a razor handle of the present invention.

Referring now to FIG. 8A, this depicts a sectional view of FIG. 6 along line 8-8 of a further embodiment of the present invention. In this embodiment the intermediate portion 490 of the biasing member is curved. This embodiment provides different spring characteristics of the biasing member which in turn provide different resistance to resilient movement of the razor cartridge in response to forces encountered during shaving. This embodiment can be preferred to compliment, for example, alternate arrangements of the razor blades within the razor cartridge or razor blades having alternate degrees of sharpness. It will be appreciated that the spring characteristics of the biasing member can be controlled by the shape and size of the biasing member.

In use, the handle of the safety razor of the embodiments of the present invention has improved connection to a razor cartridge. The handle provides improved pivoting characteristics of a razor cartridge relative to the handle. During manufacture, the embodiments of the handle of the present invention provide manufacturing advantages.

It is to be understood that the present invention is by no means limited to the particular construction herein disclosed and/or shown in the drawings, but also comprises any modifications or equivalents within the scope of the disclosure.

What is claimed is:

1. A unitary handle for a wet shaving razor, comprising: a grip portion integrally formed with a head portion comprising handle pivoting connecting structure and a biasing member;

wherein the biasing member has a first end integrally coupled with the head portion, an intermediate portion, first and second side surfaces and a second end having a single cam surface;

wherein the handle pivoting connecting structure comprises a pair of spaced apart arms each terminating in a shell bearing adapted to slidably engage a connecting structure of a razor cartridge to provide pivotal mounting on the handle about a pivot axis, wherein each shell bearing has an inner end and a fin extending therefrom toward the pivot axis in a plane generally perpendicular to the pivot axis and having a tip at the outer end thereof, and wherein at least a portion of the tip is closer to the pivot axis than any portion of the cam surface of the biasing member.

2. The handle of claim 1, wherein the handle comprises a first material and a second material and wherein the second material is a thermoplastic elastomer.

3. The handle of claim 2, wherein the cam surface of the biasing member is partially substantially cylindrical.

4. The handle of claim 3, wherein the biasing member is bifurcated.

5. The handle of claim 4, wherein the intermediate portion is substantially straight.

6. The handle of claim 5, wherein the head portion further comprises a shield portion extending inwardly from each arm, each shield portion being adjacent to and extending above at least a portion of one of the first side surface and the second side surface of the biasing member.

7. A unitary handle for a wet shaving razor, comprising: a grip portion integrally formed with a head portion comprising a handle pivoting connecting structure and a bifurcated biasing member, wherein the biasing member has a first end integrally coupled with the head portion, an intermediate portion and a second end having at least one cam surface;

wherein the handle pivoting connecting structure comprises a pair of spaced apart arms each terminating in a shell bearing adapted to slidably engage a connecting structure of a razor cartridge to provide pivotal mounting on the handle about a pivot axis, wherein each shell bearing has an inner end and a fin extending therefrom toward the pivot axis in a plane generally perpendicular to the pivot axis and having a tip at the outer end thereof, and wherein at least a portion of the tip is closer to the pivot axis than any portion of the cam surface of the biasing member.

8. A safety razor, comprising:

a unitary handle having a grip portion integrally formed with a head portion comprising a handle pivoting connecting structure and a biasing member, wherein the biasing member has a first end integrally coupled with the head portion, a substantially straight intermediate portion and a second end having a single cam surface;

wherein the handle pivoting connecting structure comprises a pair of spaced apart arms each terminating in a shell bearing adapted to slidably engage a connecting structure of a razor cartridge to provide pivotal mounting on the handle about a pivot axis, each shell bearing having an inner end and a fin extending therefrom toward the pivot axis in a plane generally perpendicular to the pivot axis and having a tip at the outer end thereof, and wherein at least a portion of the tip is closer to the pivot axis than any portion of the cam surface of the biasing member, and a razor cartridge comprising a housing and at least one razor blade having a cutting edge and a body portion adjacent the cutting edge, wherein the housing has a cam surface and arcuate bearing surfaces that slidably engage the handle pivoting connecting structure and have radii of curvature to provide pivotal mounting on the handle about the pivot axis, wherein the cam surface of the biasing member acts upon the cam surface of the housing to provide the razor cartridge an at-rest position and to permit resilient movement of the razor cartridge away from the at-rest position in response to forces encountered during shaving.

9. The razor of claim 8, wherein each fin acts to resist rotation of the razor cartridge about an axis that is both perpendicular to the pivot axis and generally perpendicular to the body portion of the razor blade.

10. The razor of claim 9, wherein the razor cartridge can rotate through an arc of travel of at least about 20° about the pivot axis.

11. The razor of claim 10, wherein the razor cartridge is adapted for pivotal movement in one direction only from the at-rest position about the pivot axis.

12. The razor of claim 10, wherein the razor cartridge is adapted for pivotal movement in both a forward or rearward direction from the at-rest position about the pivot axis and wherein the at-rest position is not in the mid position of the arc of travel.

13. The razor of claim 12, wherein the amount of rearward pivoting is greater than the amount of forward pivoting.

* * * * *